United States Patent [19]

Bucher et al.

[11] 4,238,230

[45] Dec. 9, 1980

[54] PROCESS FOR PRODUCING FREE-MACHINING STEEL

[75] Inventors: John H. Bucher; Eugene J. Paliwoda, both of Bethel Park, Pa.; Frank E. Rote, Bay Village, Ohio

[73] Assignee: Jones & Laughlin Steel Corporation, Pittsburgh, Pa.

[21] Appl. No.: 946,698

[22] Filed: Sep. 28, 1978

[51] Int. Cl.[3] ..... B22D 11/00

[52] U.S. Cl. ..... 75/123 G; 164/66; 164/82; 164/76; 164/56; 75/123 N

[58] Field of Search ..... 164/55, 56, 57, 58, 164/82, 76, 437, 415, 66; 75/123 G, 123 N, 124

[56] References Cited

U.S. PATENT DOCUMENTS

| | | | |
|---|---|---|---|
| 3,680,623 | 8/1972 | Tarmann et al. | 164/76 |
| 3,773,500 | 11/1973 | Kanazawa et al. | 75/124 |
| 3,788,383 | 1/1974 | Metz | 164/437 |
| 4,019,930 | 4/1977 | Aylward | 75/124 BA |
| 4,042,380 | 8/1977 | Yamaguchi et al. | 75/123 G |
| 4,047,556 | 9/1977 | Obinata et al. | 164/57 |
| 4,062,397 | 12/1977 | Cashdollar, Sr. | 164/415 |
| 4,091,861 | 5/1978 | Thalmann et al. | 164/437 |
| 4,102,386 | 7/1978 | Hildebrandt et al. | 164/415 |

*Primary Examiner*—Robert D. Baldwin
*Assistant Examiner*—K. Y. Lin
*Attorney, Agent, or Firm*—Thomas H. Murray

[57] ABSTRACT

A process or method used to produce a free-machining, high sulfur steel alloy is accomplished by continuously casting the molten metal rather than ingot casting and processing in a blooming mill. The process begins with a molten alloy having a high sulfur content (0.40–0.65%). The molten metal is poured from the ladle into the tundish of the continuous casting machine. From there, the molten metal is fed into an oscillating mold having the desired cross section. As the molten metal passes through the mold it is cooled to form a solidified metal body. Finally, the metal body is withdrawn and cut into the desired lengths. Additional measures may be incorporated into the process to improve the machinability and surface characteristics. They include feeding aluminum wire into the mold, protecting the casting stream from the atmosphere, and using a slide gate ladle pouring system.

6 Claims, 3 Drawing Figures

PROCESS FOR PRODUCING FREE-MACHINING STEEL

BACKGROUND OF THE INVENTION

This invention relates to a process for producing a free-machining, high sulfur steel alloy.

As is known, the so-called free-machining carbon steel alloys which do not contain lead are classified as either the 1200 Series grades or the 1100 Series grades. Steels of this type typically contain no more than about 0.35% sulfur and at least 0.30% manganese which forms, with the sulfur, manganese sulfide particles which act to improve machinability.

In the past, most alloys of this type have been formed by initial casting into ingots, the resulting ingots being processed in a blooming mill into billets which are subsequently rolled into desired shapes such as bars. When sulfur-containing steels are formed in this manner, this sulfur content cannot be increased above about 0.35% for the reason that sulfur above this limit forms iron sulfide, regardless of the amount of manganese added, which severely reduces the hot-workability of the steel to the point where it cannot be successfully hot-rolled. Nevertheless, higher amounts of manganese sulfide in the microstructure would further improve machinability of the alloy.

SUMMARY OF THE INVENTION

In accordance with the present invention, it has been found that when a free-machining, high sulfur steel alloy is produced by a continuous casting method, such as strand casting, higher amounts of sulfur, up to about 0.65% can be added to improve machinability without incurring the deleterious effects of iron sulfide. It has been found that by forming the alloy in a continuous casting process, a dense, uniform distribution of small particles of manganese sulfide results, providing a material with excellent machinability. The essential steps in the process are pouring the molten alloy having the desired chemical composition from a ladle into the tundish of a continuous casting machine; introducing the molten alloy continuously from the tundish into the continuous casting machine mold having a desired cross section to form an elongated metal body; cooling the body so as to solidify it; and continuously withdrawing the cooled metal body from the continuous casting machine.

The objects and advantages of this invention will be more completely disclosed and described in the following specification, the accompanying drawings and the appended claims.

DESCRIPTION OF THE PREFERRED EMBODIMENT

Figure 1:
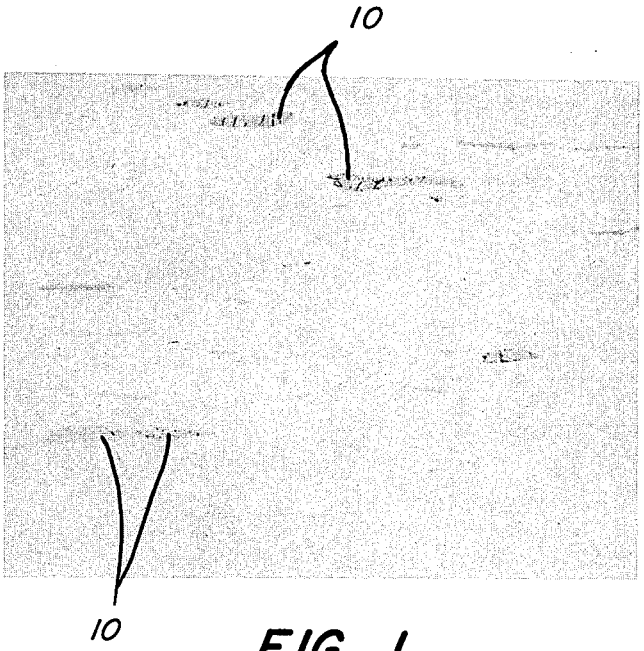
FIG. 1 (PRIOR ART)
FIG. 1 is a photomicrograph of a prior art sulfur-containing steel produced from an ingot, showing the characteristics of the particles of manganese sulfide therein.

FIG. 1 comprises a photomicrograph of a typical prior art alloy containing less than 0.40% sulfur as is produced by casting into ingots followed by an appropriate hot-rolling process. The manganese sulfide particles in the microstructure are identified by the reference numeral 10; and it will be noted that they are relatively large and random in orientation. As was explained above, in a steel of this type which is initially cast into ingots, the sulfur content cannot be increased above about 0.35% for the reason that sulfur above this limit forms iron sulfide which severely reduces the hot-workability to the point where the alloy cannot be successfully hot-rolled.

Figure 2:
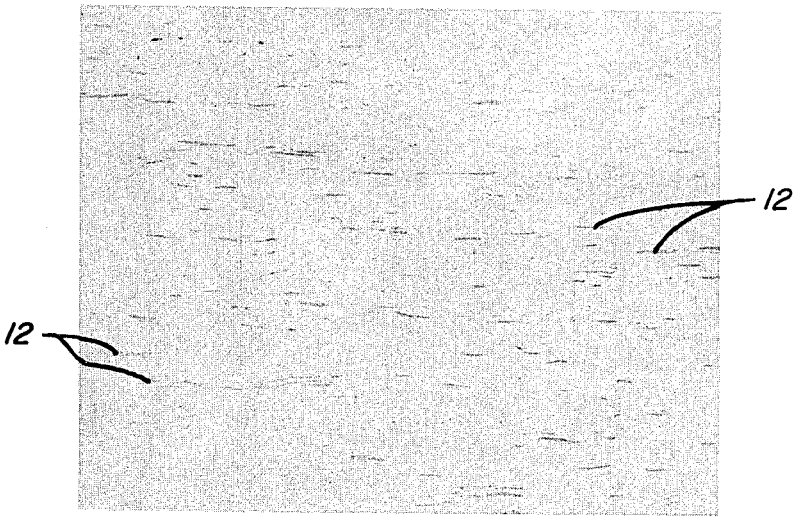
FIG. 2 is a photomicrograph of an improved alloy produced by this invention showing the fine and uniform dispersion of small particles of manganese sulfide therein.

In FIG. 2, the microstructure of an improved alloy produced by this invention is shown wherein the manganese sulfide particles are identified by the reference numeral 12. It will be noted that they are much smaller than those of the prior art alloy shown in FIG. 1 and are much more uniformly distributed throughout the microstructure. This gives the improved machinability characteristics of the alloy.

Figure 3:
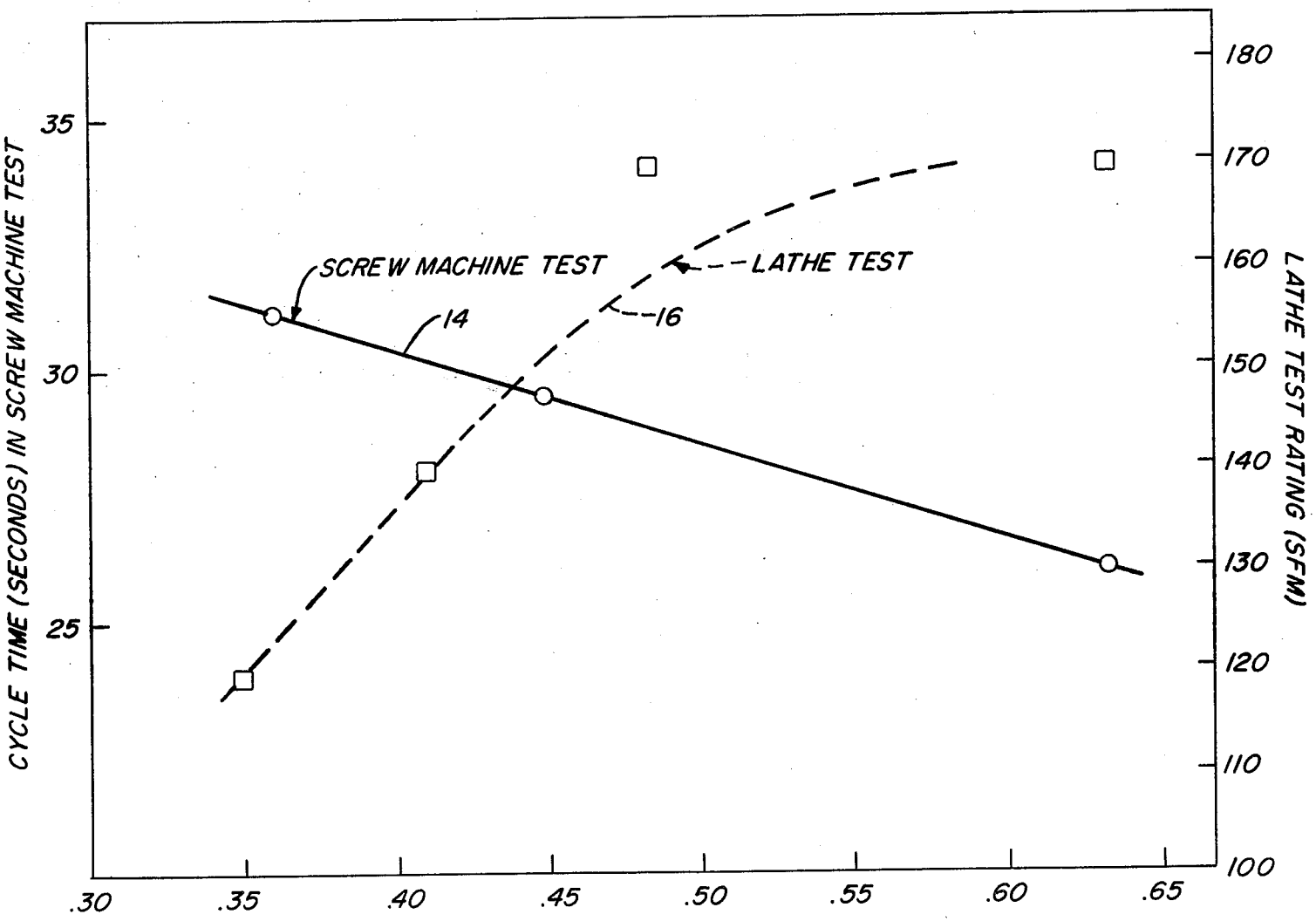
FIG. 3 is a plot of cycle time in a screw machine test for an improved alloy produced by this invention versus percent sulfur, showing the effect of the sulfur content of the alloy on machinability.

In FIG. 3, the effect of sulfur on machinability for steel containing no more than 0.09% carbon is shown. Two curves are plotted on the graph, curve 14 being a plot derived from a screw machine test and curve 16 being derived from a lathe test. The screw machine cycle time is the shortest time (per part) in which satisfactory parts can be produced continuously for an eight-hour period. Satisfactory parts will have a maximum surface roughness of about 125 microinches, and the size of the last part produced will be no more than 0.003 inch larger than the first part. When the cycle time is decreased for a particular heat of steel, the cutting speed is correspondingly increased. The size and roughness of the test parts are directly related to tool wear. All measurements are made on the major diameter of the test part which is rough formed from 1.0 inch diameter to 0.941 inch, and then finish formed to 0.937 inch.

The lathe test is performed by removing two cubic inches of metal with a hardened (i.e., 55 $R_c$) single-point turning tool. The cutting speed is alternately increased in 10 SFM increments until the fastest speed is established without encountering abrupt deterioration of the cutting tool tip. The depth of the cut is 1/16 inch, while the tool advances at a feed rate of 0.0031 inch per revolution. The lathe test is performed without lubrication, in contrast with the automatic screw machine test.

Ordinarily, the lathe test rating for cold-finished bars is defined as the fastest cutting speed for which the cutting tool tip wear does not exceed 0.00125 inch. However, it is not possible to utilize this criterion for testing hot-rolled bars. As a consequence, the above procedure was used for both cold-finished and hot-rolled bars. The lathe test results indicate a significant dependence on bar size which may reflect either vibration or temperature effects since small diameter bars are turned at a higher RPM to obtain a given surface cutting speed. Because of dependence, the lathe test results were not averaged. As can be seen from FIG. 3, sulfur above 0.40% dramatically increases the lathe test and screw machine test characteristics of the alloy.

As described previously, the process of this invention produces alloy in which the sulfur content can be increased beyond that of ingot produced free-machining steel, thereby taking advantage of the improved characteristics described for the lathe and screw machine tests. Additional techniques may be used to further refine the alloy steel produced and improve the free-machining characteristics. As the molten alloy is introduced into the oscillating mold of the continuous casting machine, aluminum wire may be fed into the mold to the coarse grain level (typically 0.002–0.008%) to minimize pinholes and oxide inclusions. Further, by protecting the casting stream from the atmosphere, reoxidation leading to pinholes and oxide inclusions can be prevented.

Due to the erosiveness of the molten alloy, a slide gate, as opposed to a stopper rod, ladle system is preferred.

An example of an alloy suitable for use in the process of this invention has the following broad and preferred ranges of composition:

TABLE I

| | Broad | Preferred |
|---|---|---|
| C | 0.09% max. | 0.09% max. |
| Mn | 1.05–1.35% | 1.15–1.35% |
| S | 0.40% min. | 0.45–0.65% |
| P | 0.04–0.09% | 0.04–0.09% |
| N | 0.001–0.012% | 0.001–0.012% |
| Si | 0.05% max. | 0.05% max. |
| Al | 0.001–0.01% | 0.002–0.008% |
| Fe | Bal. | Bal. |

As can be seen from Table I, the broad and preferred ranges for carbon is no more than 0.09%. This low carbon content tends to favor the machinability. By adding nitrogen in the range of about 0.001–0.012% the as-machined finish is improved and the alloy promotes short chips during cutting operations. These characteristics are enhanced by rephosphorizing in the range of about 0.04–0.09%. The range of manganese must be closely controlled. It should not exceed 1.35% but can be as low as 1.05%. As was explained above, the minimum sulfur content is 0.40%, but preferably in the range of about 0.45–0.65%. Silicon must not exceed 0.05% as it will cause the alloy to be less machinable. As was described previously, aluminum wire is fed into the mold in the broad range of about 0.001–0.010% and the preferred range of 0.002–0.008%.

Although the invention has been shown in connection with certain specific embodiments, it will be readily apparent to those skilled in the art that various changes in composition and method of production may be made to suit requirements without departing from the spirit and scope of the invention.

We claim:

1. A process for producing a free-machining, high sulfur steel alloy consisting of up to 0.09% carbon, 1.05–1.35% manganese, 0.40–0.65% sulfur, 0.04–0.09% phosphorus, 0.001–0.012% nitrogen, up to 0.05% silicon, 0.001–0.010% aluminum, and the balance substantially all iron with incidental impurities by continuous casting wherein the alloy is characterized by having a microstructure containing a uniform distribution of small manganese sulfide particles, the particles being smaller in size than those appearing in the microstructure of a sulfur-containing alloy produced by casting free-machining steel into ingots followed by subsequent rolling which comprises the steps of:

(a) pouring the molten alloy having the desired chemical composition from a ladle into the tundish of a continuous casting machine;

(b) introducing the molten alloy continuously from the tundish into the continuous casting machine mold having a desired cross section to form an elongated metal body;

(c) continuously protecting the casting stream from the atmosphere to prevent reoxidation leading to pinholes and oxide inclusions;

(d) cooling the elongated metal body so as to solidify the metal body; and (e) continuously withdrawing the cooled metal body from the continuous casting machine.

2. The process as recited in claim 1 which further comprises feeding aluminim into the mold to dissolve in the molten alloy to minimize pinholes and oxide inclusions.

3. The process as recited in claim 2 wherein the ladle pouring is accomplished by a slide gate pouring system.

4. A free-machining, high sulfur, low carbon, rephosphorized steel alloy characterized in having a microstructure containing a uniform distribution of small manganese sulfide particles and consisting of no more than 0.09% carbon, 1.05–1.35% manganese, 0.40–0.65% sulfur, 0.04–0.09% phosphorus, 0.001–0.012% nitrogen, no more than 0.05% silicon, 0.001–0.010% aluminum, and the balance substantially all iron with incidental impurities as is produced by the process of:

(a) pouring the molten alloy having the desired chemical composition from a ladle into the tundish of a continuous casting machine;

(b) introducing the molten alloy continuously from the tundish into the continuous casting machine mold having a desired cross section;

(c) feeding aluminum into the mold to dissolve in the molten alloy to minimize pinholes and oxide inclusions;

(d) continuously protecting the casting stream from the atmosphere to prevent reoxidation leading to pinholes and oxide inclusions;

(e) cooling the elongated metal body so as to solidify the metal body; and (f) continuously withdrawing the cooled metal body from the continuous casting machine.

5. The free-machining steel as recited in claim 4 wherein the free-machining steel is characterized by having a microstructure containing a uniform distribution of small manganese sulfide particles, the particles being smaller in size than those appearing in the microstructure of a sulfur-containing alloy produced by casting the free-machining steel into ingots followed by subsequent rolling.

6. The free-machining steel alloy as recited in claim 5 wherein manganese is present in the range of about 1.15–1.35%, sulfur is present in the range of about 0.45–0.65%, and aluminum is present in the range of about 0.002–0.008%.

* * * * *